US008733671B2

(12) United States Patent
Sturman

(10) Patent No.: US 8,733,671 B2
(45) Date of Patent: May 27, 2014

(54) FUEL INJECTORS WITH INTENSIFIED FUEL STORAGE AND METHODS OF OPERATING AN ENGINE THEREWITH

(71) Applicant: Oded Eddie Sturman, Woodland Park, CO (US)

(72) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 0 days.

(21) Appl. No.: 13/683,044

(22) Filed: Nov. 21, 2012

(65) Prior Publication Data

US 2013/0075498 A1 Mar. 28, 2013

Related U.S. Application Data

(62) Division of application No. 12/502,827, filed on Jul. 14, 2009, now abandoned.

(60) Provisional application No. 61/080,955, filed on Jul. 15, 2008, provisional application No. 61/101,925, filed on Oct. 1, 2008, provisional application No. 61/145,874, filed on Jan. 20, 2009.

(51) Int. Cl.
*F02M 47/02* (2006.01)
*F02M 57/02* (2006.01)

(52) U.S. Cl.
CPC ..... *F02M 57/026* (2013.01); *F02M 57/025* (2013.01)
USPC ..... 239/88; 239/96; 239/533.1; 123/445

(58) Field of Classification Search
CPC ..... F02M 57/025; F02M 57/026
USPC ..... 239/88–92, 96, 533.1–533.15; 123/445
See application file for complete search history.

(56) References Cited

U.S. PATENT DOCUMENTS

| | | | |
|---|---|---|---|
| 1,701,089 | A | 2/1929 | von Salis |
| 2,537,087 | A | 1/1951 | Pyk et al. |
| 2,606,066 | A | 8/1952 | Thompson |

(Continued)

FOREIGN PATENT DOCUMENTS

| | | |
|---|---|---|
| DE | 10250130 | 3/2004 |
| DE | 102004030447 | 1/2006 |

(Continued)

OTHER PUBLICATIONS

"Advisory Action Dated May 29, 2012, U.S. Appl. No. 12/751,118" (May 29, 2012).

(Continued)

*Primary Examiner* — Jason J Boeckmann
*Assistant Examiner* — Joel Zhou
(74) *Attorney, Agent, or Firm* — Blakely Sokoloff Taylor & Zafman LLP

(57) ABSTRACT

Fuel injectors with intensified fuel storage and methods of operating an engine therewith. At least one storage cavity is provided in the intensifier type fuel injector, with a check valve between the intensifier and the needle chamber and storage cavity preventing loss of injection pressure while the intensifier plunger cylinder is refilling with fuel. This provides very efficient injector operation, particularly at low engine loads, by eliminating the wasted energy of compressing, venting and recompressing fuel for injection. Various injector designs and methods of operating the same in an engine are disclosed.

13 Claims, 3 Drawing Sheets

(56) References Cited

U.S. PATENT DOCUMENTS

| | | | |
|---|---|---|---|
| 2,722,924 | A | 11/1955 | Hedges |
| 3,640,466 | A | 2/1972 | Steiger |
| 4,006,859 | A | 2/1977 | Thoma |
| 4,173,208 | A | 11/1979 | Fenne et al. |
| 4,256,064 | A | 3/1981 | Thorn |
| 4,440,132 | A | 4/1984 | Terada et al. |
| 4,627,571 | A | 12/1986 | Kato et al. |
| 4,782,794 | A | 11/1988 | Hsu et al. |
| 4,821,689 | A | 4/1989 | Tittizer et al. |
| 4,856,713 | A | 8/1989 | Burnett |
| 5,108,070 | A | 4/1992 | Tominaga |
| 5,237,976 | A | 8/1993 | Lawrence et al. |
| 5,341,783 | A | 8/1994 | Beck et al. |
| 5,419,492 | A | 5/1995 | Gant et al. |
| 5,421,521 | A | 6/1995 | Gibson et al. |
| 5,423,484 | A | 6/1995 | Zuo |
| 5,429,309 | A | 7/1995 | Stockner |
| 5,440,968 | A | 8/1995 | Sekine |
| 5,441,027 | A | 8/1995 | Buchanon et al. |
| 5,460,329 | A | 10/1995 | Sturman |
| 5,463,996 | A | 11/1995 | Maley et al. |
| RE35,303 | E | 7/1996 | Miller et al. |
| 5,551,398 | A | 9/1996 | Gibson et al. |
| 5,638,781 | A | 6/1997 | Sturman |
| 5,640,987 | A | 6/1997 | Sturman |
| 5,641,121 | A | 6/1997 | Beck et al. |
| 5,669,355 | A | 9/1997 | Gibson et al. |
| 5,673,669 | A | 10/1997 | Maley et al. |
| 5,682,858 | A | 11/1997 | Chen et al. |
| 5,687,693 | A | 11/1997 | Chen et al. |
| 5,697,342 | A | 12/1997 | Anderson et al. |
| 5,713,316 | A | 2/1998 | Sturman |
| 5,722,373 | A | 3/1998 | Paul et al. |
| 5,727,525 | A | 3/1998 | Tsuzuki |
| 5,732,679 | A | 3/1998 | Takahasi et al. |
| 5,738,075 | A | 4/1998 | Chen et al. |
| 5,752,659 | A | 5/1998 | Moncelle |
| 5,771,865 | A | 6/1998 | Ishida |
| 5,779,149 | A | 7/1998 | Hayes, Jr. |
| 5,806,474 | A | 9/1998 | Paul et al. |
| 5,826,562 | A | 10/1998 | Chen et al. |
| 5,833,146 | A | 11/1998 | Hefler |
| 5,873,526 | A | 2/1999 | Cooke |
| 5,906,351 | A | 5/1999 | Aardema et al. |
| 5,941,215 | A | 8/1999 | Augustin |
| 5,950,931 | A | 9/1999 | Beatty et al. |
| 5,954,030 | A | 9/1999 | Sturman et al. |
| 5,960,753 | A | 10/1999 | Sturman |
| 5,970,956 | A | 10/1999 | Sturman |
| 5,979,803 | A | 11/1999 | Peters et al. |
| 6,012,430 | A | 1/2000 | Cooke |
| 6,012,644 | A | 1/2000 | Sturman et al. |
| 6,026,785 | A | 2/2000 | Zuo |
| 6,027,047 | A | 2/2000 | Augustin |
| 6,047,899 | A | 4/2000 | Graves |
| 6,085,991 | A | 7/2000 | Sturman |
| 6,112,721 | A | 9/2000 | Kouketsu et al. |
| 6,113,000 | A | 9/2000 | Tian |
| 6,113,014 | A | 9/2000 | Coldren et al. |
| 6,119,960 | A | 9/2000 | Graves |
| 6,148,778 | A | 11/2000 | Sturman |
| 6,161,770 | A | 12/2000 | Sturman |
| 6,173,685 | B1 | 1/2001 | Sturman |
| 6,257,499 | B1 | 7/2001 | Sturman |
| 6,308,690 | B1 | 10/2001 | Sturman |
| 6,328,003 | B1 | 12/2001 | Gaertner et al. |
| 6,360,728 | B1 | 3/2002 | Sturman |
| 6,374,784 | B1 | 4/2002 | Tischer et al. |
| 6,378,497 | B1 | 4/2002 | Keyster et al. |
| 6,412,706 | B1 | 7/2002 | Guerrassi et al. |
| 6,415,749 | B1 | 7/2002 | Sturman et al. |
| 6,474,304 | B1 | 11/2002 | Lei |
| 6,550,453 | B1 | 4/2003 | Tian |
| 6,557,506 | B2 | 5/2003 | Sturman |
| 6,575,126 | B2 | 6/2003 | Sturman |
| 6,575,384 | B2 | 6/2003 | Ricco |
| 6,592,050 | B2 | 7/2003 | Boecking |
| 6,647,966 | B2 | 11/2003 | Tian et al. |
| 6,655,355 | B2 | 12/2003 | Kropp et al. |
| 6,684,853 | B1 | 2/2004 | Lei |
| 6,684,856 | B2 | 2/2004 | Tanabe et al. |
| 6,684,857 | B2 | 2/2004 | Boecking |
| 6,722,127 | B2 | 4/2004 | Scuderi et al. |
| 6,745,958 | B2 | 6/2004 | Lei |
| 6,766,792 | B2 | 7/2004 | Messinger et al. |
| 6,769,635 | B2 | 8/2004 | Stewart et al. |
| 6,776,138 | B2 | 8/2004 | Mahr et al. |
| 6,802,298 | B2 | 10/2004 | Yoshimura et al. |
| 6,811,103 | B2 | 11/2004 | Gurich et al. |
| 6,830,202 | B2 | 12/2004 | Coldren |
| 6,845,926 | B2 | 1/2005 | Lei |
| 6,868,831 | B2 | 3/2005 | Lei |
| 6,880,501 | B2 | 4/2005 | Suh et al. |
| 6,908,040 | B2 | 6/2005 | Dong et al. |
| 6,910,462 | B2 | 6/2005 | Sun et al. |
| 6,910,463 | B2 | 6/2005 | Oshizawa et al. |
| 6,918,358 | B2 | 7/2005 | Hu |
| 6,951,204 | B2 | 10/2005 | Shafer et al. |
| 7,108,200 | B2 | 9/2006 | Sturman |
| 7,182,068 | B1 | 2/2007 | Sturman et al. |
| 7,278,593 | B2 | 10/2007 | Wang et al. |
| 7,293,547 | B2 | 11/2007 | Ibrahim |
| 7,412,969 | B2 | 8/2008 | Pena et al. |
| 7,568,632 | B2 | 8/2009 | Sturman |
| 7,568,633 | B2 | 8/2009 | Sturman |
| 7,694,891 | B2 | 4/2010 | Sturman |
| 7,717,359 | B2 | 5/2010 | Sturman |
| 7,753,037 | B2 | 7/2010 | Hatamura |
| 7,841,324 | B2 | 11/2010 | Dirker et al. |
| 2002/0053340 | A1 | 5/2002 | Lei |
| 2003/0155437 | A1 | 8/2003 | Lei |
| 2003/0178508 | A1 | 9/2003 | Coldren |
| 2003/0183198 | A1* | 10/2003 | Mahr et al. ..... 123/447 |
| 2003/0196646 | A1 | 10/2003 | Shoyama et al. |
| 2004/0000600 | A1 | 1/2004 | Peters et al. |
| 2004/0129255 | A1 | 7/2004 | Stuhldreher et al. |
| 2004/0140161 | A1 | 7/2004 | Clancy et al. |
| 2004/0168673 | A1* | 9/2004 | Shinogle ..... 123/456 |
| 2004/0188537 | A1 | 9/2004 | Sturman |
| 2004/0195385 | A1 | 10/2004 | Lawrence et al. |
| 2004/0238657 | A1 | 12/2004 | Sturman |
| 2005/0066918 | A1 | 3/2005 | Yamakawa et al. |
| 2005/0092306 | A1 | 5/2005 | Shinogle et al. |
| 2006/0032940 | A1 | 2/2006 | Boecking |
| 2006/0075995 | A1 | 4/2006 | Liu et al. |
| 2006/0123773 | A1 | 6/2006 | Zhang |
| 2006/0150931 | A1* | 7/2006 | Sturman ..... 123/64 |
| 2006/0150954 | A1 | 7/2006 | Moore |
| 2006/0157581 | A1 | 7/2006 | Kiss et al. |
| 2006/0243253 | A1 | 11/2006 | Knight |
| 2007/0209615 | A1 | 9/2007 | Epshteyn |
| 2007/0251220 | A1 | 11/2007 | Dawson et al. |
| 2007/0272221 | A1 | 11/2007 | Branyon et al. |
| 2008/0277504 | A1* | 11/2008 | Sturman ..... 239/533.3 |
| 2009/0056670 | A1 | 3/2009 | Zhao et al. |
| 2009/0151686 | A1 | 6/2009 | Nguyen |
| 2009/0283061 | A1 | 11/2009 | Branyon et al. |
| 2010/0012745 | A1 | 1/2010 | Sturman |
| 2010/0186716 | A1 | 7/2010 | Sturman |
| 2011/0094462 | A1 | 4/2011 | Durrett et al. |
| 2011/0163177 | A1 | 7/2011 | Kiss |

FOREIGN PATENT DOCUMENTS

| | | |
|---|---|---|
| DE | 102005028400 | 2/2006 |
| DE | 102005060647 | 6/2006 |
| EP | 1593839 | 11/2005 |
| JP | 61/008459 | 1/1986 |
| JP | 61/096169 | 5/1986 |
| WO | WO-02/073024 | 9/2002 |

(56) References Cited

FOREIGN PATENT DOCUMENTS

| | | |
|---|---|---|
| WO | WO-2006/008727 | 1/2006 |
| WO | WO-2008/141237 | 11/2008 |

OTHER PUBLICATIONS

"International Search Report and Written Opinion of the International Searching Authority Dated Aug. 21, 2008", International Application No. PCT/US2008/063321, (Aug. 21, 2008).
"International Search Report and Written Opinion of the International Searching Authority Dated Jan. 25, 2010", International Application No. PCT/US2009/050736, (Jan. 25, 2010).
"Notice of Allowance Mailed Dec. 30, 2009, U.S. Appl. No. 12/118,542" (Dec. 30, 2009).
"Notice of Allowance Mailed Jun. 27, 2011, Chinese Patent Application No. 200880015290.X" (Jun. 27, 2011).
"Office Action Dated Jul. 13, 2012, European Patent Application No. 09790488.2" (Jul. 13, 2012).
"Office Action Dated Sep. 13, 2011, European Patent Application No. 09790488.2" (Sep. 13, 2011).
"Office Action Dated Aug. 23, 2012, U.S. Appl. No. 12/502,827" (Aug. 23, 2012).
"Office Action Dated Aug. 31, 2012; Chinese Patent Application No. 200980136227.6" (Aug. 31, 2012).
"Office Action Dated Dec. 31, 2010, Chinese Patent Application No. 200880015290.X" (Dec. 31, 2010).
"Office Action Dated Dec. 5, 2012, Chinese Patent Application No. 201110259364.8" (Dec. 5, 2012).
"Office Action Dated Mar. 5, 2012, U.S. Appl. No. 12/751,118" (Mar. 5, 2012).
"Office Action Dated May 22, 2012, U.S. Appl. No. 12/502,827" (May 22, 2012).
"Office Action Dated Nov. 7, 2011, U.S. Appl. No. 12/751,118" (Nov. 7, 2011).
"Notice of Allowance Mailed Jul. 5, 2013; U.S. Appl. No. 12/751,118", (Jul. 5, 2013).
"Notification on Grant of Patent Right for Invention Dated May 30, 2013; Chinese Patent Application No. 201110259364.8", (May 30, 2013).
"Office Action Dated Apr. 22, 2013; Chinese Patent Application No. 200980136227.6", (Apr. 22, 2013).
Office Action Dated Dec. 10, 2013; Chinese Patent Application No. 200980136227.6, (Dec. 10, 2013).
Office Action Dated Nov. 25, 2013; European Patent Application No. 09790488.2, (Nov. 25, 2013).

* cited by examiner

FIG. 3
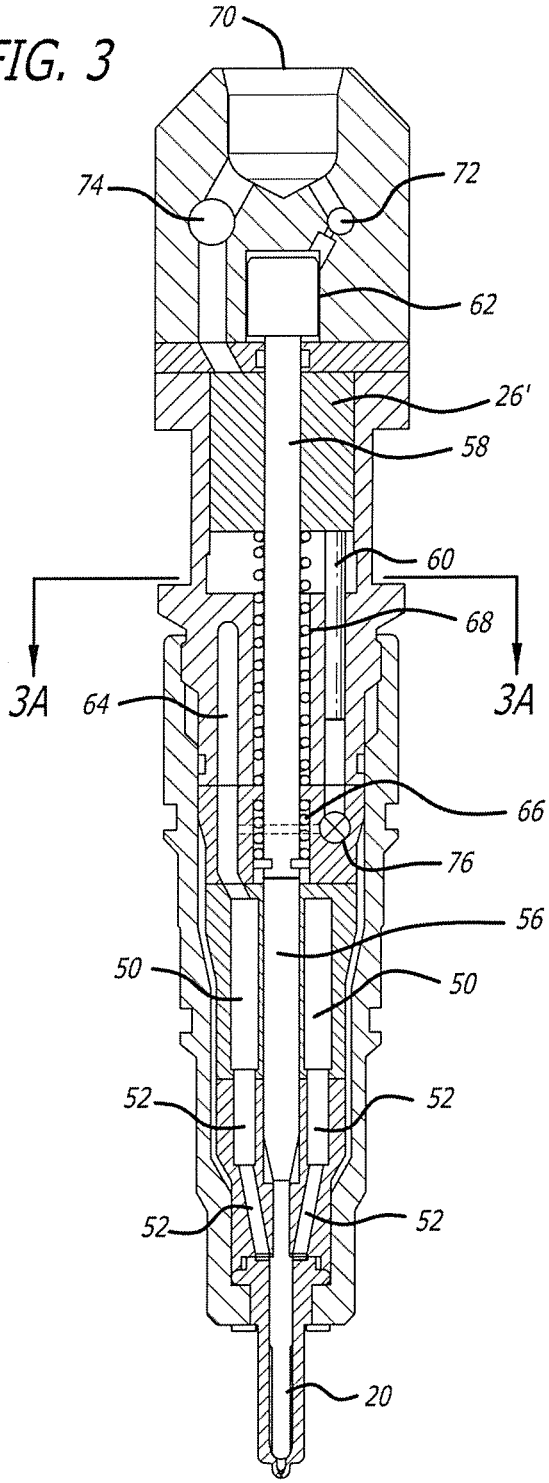
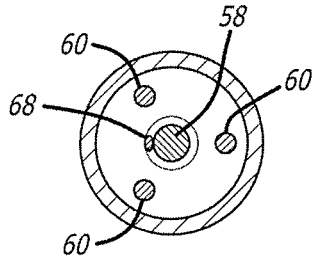
FIG. 3A

FUEL INJECTORS WITH INTENSIFIED FUEL STORAGE AND METHODS OF OPERATING AN ENGINE THEREWITH

CROSS-REFERENCE TO RELATED APPLICATIONS

This application is a divisional of U.S. patent application Ser. No. 12/502,827 filed Jul. 14, 2009 which claims the benefit of U.S. Provisional Patent Application No. 61/080,955 filed Jul. 15, 2008, U.S. Provisional Patent Application No. 61/101,925 filed Oct. 1, 2008 and U.S. Provisional Patent Application No. 61/145,874 filed Jan. 20, 2009.

BACKGROUND OF THE INVENTION

1. Field of the Invention

The present invention relates to the field of fuel injectors and fuel injection systems.

2. Prior Art

Fuel injector performance, particularly in diesel engines, has a substantial influence in overall engine performance, especially with respect to emissions. Of particular importance is the speed at which fuel injection can be terminated. In particular, if fuel injection is terminated merely by the reduction in injection pressure it is difficult to rapidly terminate injection because of the compressability of the fuel and actuation fluid in an intensifier type fuel injector, resulting in a trail off in atomization resulting in unacceptable levels of unburned fuel in the exhaust. Accordingly various types of direct needle control have been proposed to provide injection control other than by controlling injection pressure.

Also fuel injectors, particularly diesel fuel injectors, are using ever increasing injection pressures, now going as high as 3000 bar (45,000 psi). Diesel fuel has a compressibility of approximately 1% per 67 bar (1000 psi), so that at the injection pressure, the fuel has been substantially compressed. In intensifier type fuel injectors, injection occurs directly as a result of intensification, so that injection begins on intensification and terminates on termination of intensification. Consequently the volume of fuel intensified is set equal to the maximum injection volume needed, plus of course some overhead volume for the needle chamber, passageways to the needle chamber, etc. At a partial power setting for the engine, much less than the maximum injection volume is needed, yet the full amount is compressed and then depressurized, losing the energy required for the compression of the fuel not injected, which at low power settings and at idle, can be most of the substantial amount of energy used for intensification. In fuel injectors having direct needle control, the operation is a bit different, in that intensification occurs, then injection by the direct needle control, then termination of injection, again by direct needle control, and then depressurization to refill the intensification chamber for the next cycle. While this cycle is a bit different, the losses of intensification energy are not different.

Injectors using direct needle control to control injection of fuel supplied to the injector at injection pressure are also known. These injection systems are more efficient because fuel, once compressed, is sooner or later all injected regardless of the engine power setting. They also have the advantage of not cycling the fuel pressure in the needle chamber on each injection event, helping reduce, but not eliminate, the possibility of eventual injector tip breakage. However such systems have serious drawbacks. Aside from the safety issues of having a rail at injection pressures and the associated plumbing problems, there is a serious risk to the engine, in that if an injection tip breaks off, a direct and continuous flow path from the high pressure rail to the combustion chamber is provided, which could result in a hydraulic lock of the engine with catastrophic results.

BRIEF DESCRIPTION OF THE DRAWINGS

FIG. 3 is a cross section of an alternate embodiment.

FIG. 3A is a cross section taken along line 3*a*_3*a* of FIG. 3.

DETAILED DESCRIPTION OF THE PREFERRED EMBODIMENTS

In the description to follow, the phrase injection event refers to a complete injection event, which may comprise sub-events, such as, by way of one example, a pre-injection, followed by a main injection, either as a single main injection, or a series of smaller injections. An injection event may begin at any time after the end of a combustion cycle (power stroke) and will end before the end of the next combustion cycle (power stroke). Thus successive injection events in an engine operating in a two stroke or two cycle mode will occur each engine crankshaft rotation (each 360 degrees of crankshaft rotation), while successive injection events in an engine operating in a four stroke or four cycle mode will occur each pair of engine crankshaft rotations (each 720 degrees of crankshaft rotation).

Figure 1:
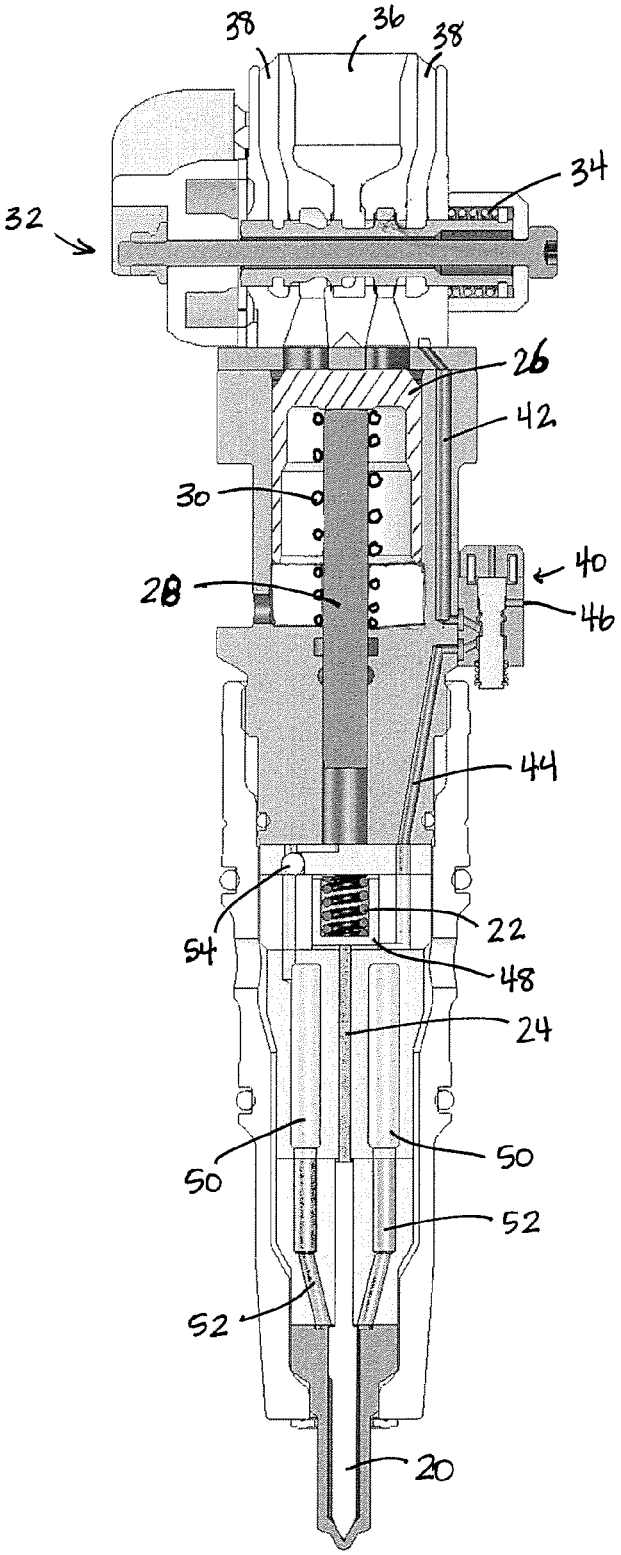
FIG. 1 is a cross section of a fuel injector in accordance with the present invention.

First referring to FIG. 1, a cross section of one embodiment injector in accordance with the present invention may be seen. The injector includes a needle 20, normally held in the closed position by a spring 22 acting on a member 24 pushing against the top of the needle 20. The injector is an intensifier type injector with intensifier piston 26 actuated by lower pressure actuation fluid acting against the top of plunger 28, with coil spring 30 and fuel inlet pressure through a check valve (not shown) returning the intensifier piston 26 and plunger 28 to their unactuated position between injections. At the top of the injector is a single solenoid actuated three-way spool valve generally indicated by the numeral 32, with spring return 34, which valve when in a first position will couple actuation fluid through port 36 to the region above the intensifier piston 26 or, alternatively, when in the second position, will couple the region above intensifier piston 26 to vents 38.

A second smaller spool valve generally indicated by the numeral 40 is coupled to the side of the injector for direct needle control. In a preferred embodiment, spool valve 40 is a three-way magnetically latching spool valve, magnetically latching on actuation, and releasing for spring return on receipt of a small reverse current, though other types of valves, including other spool valves may be used if desired. In the embodiment disclosed, the valve either couples actuation fluid pressure in line 42 to line 44 when actuated, or alternatively, blocks the flow of actuation fluid in line 42 and couples line 44 to a low pressure vent 46 when the spool is released. Through the three-way valve 40, pressure in line 44 controllably pressurizes the region under piston 48, which in turn controls actuator pin 24. The area above piston 48 is permanently coupled to the source of actuation fluid under pressure, and accordingly is always pressurized when the engine is running. For piston 48 and the intensifier, the actuation fluid is preferably engine oil, though some other actuation fluid may be used, such as fuel.

In operation, with the area under piston 48 vented, spring 22 and actuation fluid pressure above piston 48 will hold the needle closed, even against intensified fuel pressure in the needle chamber. When injection is to occur, needle control valve 40 is actuated to couple actuation fluid pressure to the region below piston 48, which pressure balances the piston, allowing intensified fuel pressure in the needle chamber to force the needle open against spring 22. Of course at the end of injection, the needle control valve 40 is released, to again vent the area under piston 48 to allow actuation fluid pressure over piston 48 to force the needle closed. Of course the needle control valve 40 may be operated more than once, first to provide a pre-injection, followed by a second injection, or even to provide pulsed injections.

Figure 2:
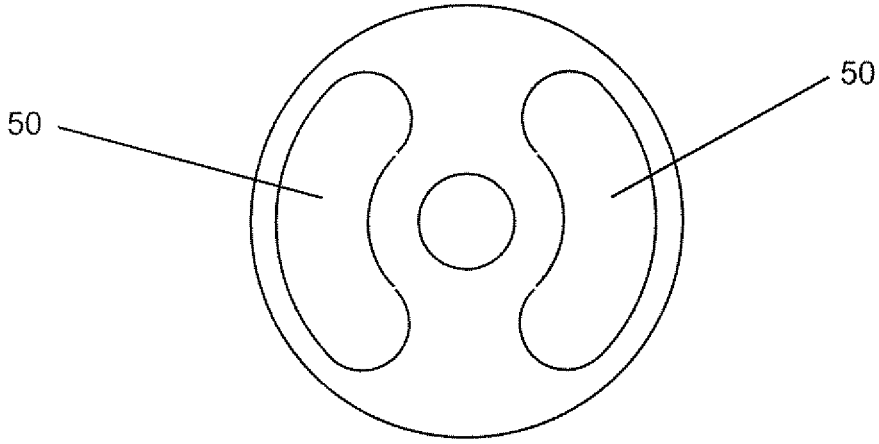
FIG. 2 is an illustration of the high pressure fuel storage in the lower section of the fuel injector.

Of particular importance to the present invention are the large storage volumes 50, also shown in the cross section of FIG. 2, the generous porting 52 and the (ball) check valve 54. This is contrary to the prior art, where this would be considered energy wasting volume because of its constant pressurization and depressurization. In the present invention, the storage of fuel at the intensified pressure is facilitated by check valve 54, which prevents depressurization of the intensified fuel pressure when the intensifier is recycled. Instead, injection is controlled by the needle control valve 40. Thus the pressurized actuation fluid may be left acting on intensifier piston 26 until recycling the intensifier after it begins to reach the limit of its stroke. This allows essentially all fuel having a pressure intensified by the intensifier, including that stored in the storage volumes 50 and generous porting and that still in the intensifier below plunger 28, be used for injection, typically during multiple successive injection events. The intensifier need only be recycled on an as required basis, rather on each injection event. The electronic control system that controls injection may also keep track of the amount of fuel injected on each injection event, and recycle the intensifier when required. At idle and during low power settings, the intensifier need only be recycled after numerous injection events. Even at a maximum power setting, preferably the storage provided is adequate for multiple injection events. This can allow injection to actually occur during recycling of the intensifier, albeit with a temporarily decreasing injection pressure. This can be useful when an engine goes from a low power setting wherein the fuel at the intensified pressure is adequate for multiple further injections, to a high power setting requiring the injection of more fuel than is left under the plunger 28. Even at a fixed power setting, this can allow letting the intensifier approach the limit of its travel before recycling during an injection event. Depending on the relative volumes, initially the intensifier may need to be cycled more than once to adequately pressurize the fuel in the storage volume 50.

Alternatively, a sensor such as a Hall effect sensor may be used to sense when the intensifier reaches or approaches the limit of its travel to trigger intensifier recycling, regardless of whether injection is occurring or not, or between injection events. As a further alternative, the intensifier may have a displacement less than the volume of fuel injected during an injection event at maximum engine power, and be operated multiple times between and during an injection event at maximum power.

The present invention provides all the advantages and eliminates the disadvantages of a fuel rail at high injection pressures. In that regard, preferably the total storage volume, intensifier plus storage in porting and storage 50, is less than that that would cause a hydraulic lock in the engine cylinder is dumped into the cylinder on breakage of the injector tip. Also, the storage volume should not be so large as to jeopardize the structural integrity of the injector. Of course, while one exemplary form of direct needle control has been disclosed for purposes of setting the environment for the present invention, substantially any form of direct needle control may be used. Also while the check valve 54 is shown as a ball valve, other forms of check valves may also be used.

The exemplary embodiment of injector disclosed herein also uses intensifier actuation fluid for direct needle control. Alternatively, intensified fuel pressure may be used for direct needle control. This is not preferred however, because of the valving difficulties at the intensified pressure. Of course, substantially any method of direct needle control may be used with the present invention, as it is the combination of direct needle control, however done, together with the ability to store fuel at the intensified pressure, that provides the performance and efficiency characteristics of the present invention.

Now referring to FIG. 3, and alternate embodiment of the present invention may be seen. This embodiment is functionally the same as the previously embodiment, though has a more convenient mechanical arrangement. The embodiment of FIG. 3 includes a needle 20 with large storage regions 50 and generous porting 52 between the needle 20 and the storage regions 50. The major difference between the embodiment of FIG. 3 and FIG. 1, however, is the general arrangement of the intensifier and direct needle control. In particular, needle control pins 56 and 58 extend upward along the axis of the injector to a direct needle control piston 62 adjacent the top of the injector.

In the embodiment of FIG. 3, the intensifier piston 26' is concentric with the needle control pin 58 and operates against multiple plunger pins 60. In one embodiment, this comprises three plunger pins (see FIG. 3A), plumbed together and ported to storage regions 50 through porting not shown in the Figure. Between the plunger pins 60 are additional storage volumes 64, which are also plumbed to the storage volumes 50. The upper needle control pin 58 in this embodiment is encouraged to its downward most position by a relatively light spring 66, with an additional return spring 68 for the intensifier piston 26. The return of the plunger pins 60 is by way of fuel pressure provided underneath the plunger pins 60 from a relatively low pressurized fuel source through a ball valve which subsequently seals against intensified fuel pressures, as is well known in the art.

The operation of the embodiment of FIG. 3 is as follows. Engine oil under pressure is provided through port 70 to a small spool valve 72, shown schematically, and a larger spool valve 74, also shown schematically. The two spool valves 72 and 74 are preferably three-way valves. The spool valve 72 provides direct needle control, and when porting the engine oil through port 70 to the top of piston 62, holds the needle 20 down against the needle seat to seal the same against fuel at intensified pressure. Thus as before, spool valve 74 may be used to port engine oil through port 70 to the top of intensifier piston 26' to intensify the fuel pressure, with the intensification remaining typically through a plurality of injections as controlled by the needle control spool valve 72. When the intensifier piston 26' approaches the bottom of its range of travel, spool valve 74 is actuated to cut off engine oil communication between port 70 and the top of the intensifier piston 26', and instead will couple the region above intensifier 26' to a vent or low pressure oil sump, typically directly or indirectly back to the engine crankcase. During this time a ball valve 76 similar to ball valve 54 of FIG. 1 is used to retain the intensification pressure on the remaining intensified fuel while the intensifier is cycled to intensify another charge, preferably between injection events.

The preferred method of operating the present invention is to operate the intensifier throughout the full duration of the injection event, recycling the intensifier only between injection events. This has the advantages of maintaining the highest pressure, and a uniform pressure, throughout the injection event, providing maximum atomization and repeatability in the injector operation.

Thus one aspect of the present invention is that it can very substantially reduce the energy loss of prior art intensifier type fuel injectors and methods of operation thereof by using (injecting) all or substantially all the fuel at the intensified pressure before intensifying another fuel charge. This may allow a single intensification for use over multiple injection events (injection over multiple combustion cycles), particularly at low engine power settings, where depressurizing (de-intensifying) and re-intensification a large part of the intensified fuel not used in an injection event is particularly wasteful of the quite substantial energy used for intensification.

While certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. An intensifier type fuel injector comprising: a needle chamber; a needle in the needle chamber having a first position blocking fuel injection and a second position allowing fuel injection; an intensifier having an intensifier piston and a plurality of plunger pins for intensifying a fuel pressure responsive to an intensifier actuation fluid pressure, wherein the plunger pins are distributed around the axis of the intensifier piston and needle; first valving coupled to control intensifier actuation fluid over the intensifier piston; second valving responsive to a needle actuation fluid to controllably; maintain the needle in the first position against an intensified fuel pressure in the needle chamber, or allow the needle to move toward the second position responsive to intensified fuel pressure in the needle chamber; a needle control piston; at least one intensified fuel storage volume coupled through a port to the needle chamber; and, a check valve coupled to allow fuel flow from the plunger pin to the needle chamber and the at least one storage volume, and to block fuel flow in the opposite direction; the needle control piston, the intensifier piston and the needle being coaxial, and the intensifier piston is between the needle control piston and the needle; wherein the needle control piston controls the needle through at least one needle control pin concentric with and passing through the intensifier piston.

2. The fuel injector of claim 1 wherein the number of intensifier plungers is one, and the intensifier piston and the intensifier plunger are both coaxial with the needle.

3. The fuel injector of claim 2 wherein the second valving is at a side of the intensifier.

4. The fuel injector of claim 1 wherein the intensifier actuation fluid and the needle actuation fluid are from the same source of actuation fluid.

5. The fuel injector of claim 4 wherein the actuation fluid is engine oil.

6. The fuel injector of claim 1 further comprising:

a needle control piston having needle actuation fluid pressure on a first surface of the needle control piston to force the needle toward the first needle position, and the second valving controls needle actuation fluid pressure on a second surface of the needle control piston opposite the first surface, intensified fuel pressure in the needle chamber moving the needle toward the second position when the needle actuation fluid pressures on the first and second surfaces of the needle actuation piston are equal.

7. The fuel injector of claim 6 wherein the number of intensifier plungers is one, and the intensifier piston, the intensifier plunger and the needle control piston are all coaxial with the needle.

8. The fuel injector of claim 7 wherein the needle control piston is between the intensifier plunger and the needle.

9. The fuel injector of claim 8 wherein the second valving is at a side of the intensifier.

10. The fuel injector of claim 9 wherein the intensifier actuation fluid and the needle actuation fluid are from the same source of actuation fluid.

11. The fuel injector of claim 1 further comprising:

a spring encouraging the needle to the first position when the intensifier actuation fluid and the needle actuation fluid are not under pressure.

12. The fuel injector of claim 1 wherein the at least one intensified fuel storage volume comprises at least one arc shaped cavity between the intensifier plunger and the needle chamber.

13. The fuel injector of claim 1 further comprising: the second valving controlling needle actuation fluid pressure on a surface of the needle control piston to move the needle to the first position when needle actuation fluid pressure is applied to the surface of the needle control piston, and pressure in the needle chamber forcing the needle toward the second position when needle actuation fluid pressure is not applied to the surface of the needle control piston.

* * * * *